US006736523B2

(12) United States Patent
Alvey

(10) Patent No.: US 6,736,523 B2
(45) Date of Patent: May 18, 2004

(54) FLASHLIGHT ACCESSORY DEVICE

(76) Inventor: James R. Alvey, 7803 Fountainhead Pl., Fort Wayne, IN (US) 46835

( * ) Notice: Subject to any disclaimer, the term of this patent is extended or adjusted under 35 U.S.C. 154(b) by 0 days.

(21) Appl. No.: 09/798,549

(22) Filed: Mar. 2, 2001

(65) Prior Publication Data

US 2002/0021565 A1 Feb. 21, 2002

Related U.S. Application Data

(60) Provisional application No. 60/186,878, filed on Mar. 3, 2000.

(51) Int. Cl.[7] ..... F21V 33/00
(52) U.S. Cl. ..... 362/158; 362/96; 362/208
(58) Field of Search ..... 362/96, 101, 109, 362/158, 208, 267, 202; 222/113, 142.3, 192

(56) References Cited

U.S. PATENT DOCUMENTS 2,296,287 A * 9/1942 Leyde ..... 362/158
2,404,681 A * 7/1946 Baack ..... 362/158
3,016,549 A * 1/1962 Finn ..... 362/158
3,638,836 A 2/1972 Vickers, II
3,716,170 A 2/1973 Mangels
3,776,429 A 12/1973 DeLucia
4,242,724 A 12/1980 Stone
4,782,432 A 11/1988 Coffman
4,792,883 A * 12/1988 Ackerman et al. ..... 362/102
4,858,083 A * 8/1989 Wakimoto ..... 362/208
5,086,377 A 2/1992 Roberts
5,446,985 A 9/1995 Chen
5,941,629 A 8/1999 Tuscher

* cited by examiner

*Primary Examiner*—Y My Quach Lee
(74) *Attorney, Agent, or Firm*—Randall J. Knuth

(57) ABSTRACT

A combination flashlight and container device comprising a first casing including a battery operated, manual flashlight with a threaded end, and a second casing detachably connected to the first casing at the threaded end, the second casing having a sealable and totally enclosed compartment.

13 Claims, 4 Drawing Sheets

FLASHLIGHT ACCESSORY DEVICE

This application claims the benefit of Provisional application Ser. No. 60/186,878, filed Mar. 3, 2000.

BACKGROUND OF THE INVENTION

1. Field of the Invention

The present invention relates generally to flashlights, and more particularly to an apparatus for storing additional articles in and with the flashlight.

2. Description of the Related Art

Battery powered flashlights have become more powerful and have new uses in recent years, particularly with police, security emergency, medical professionals, and fire professionals. One type of flashlight that has met commercial success is the Mag-Lite® brand flashlight produced by Mag Instruments, Inc.

At times, operators of a flashlight may have a need to store or conceal other articles, such as matches, keys, or personal defense sprays, such as pepper sprays and the like. Furthermore, some flashlights, particularly high powered flashlights do not includes the ability to float when submerged into liquid.

SUMMARY OF THE INVENTION

The present invention is an apparatus and method for attaching an auxiliary container to a flashlight. The present invention further includes an auxiliary container shaped to have, in one form of the invention, the same exterior diameter as the flashlight body. In one form of the invention, the end cap of the flashlight is removed, and the auxiliary container is attached to where the end cap had attached.

The auxiliary container may include a water proof end cap for storing articles therein.

In another form of the invention, the auxiliary container may contain and hold a personal defense spray, such as pepper spray or MACE, for flashlight operator use. The container in this embodiment would include a finger port for access to the trigger of the personal defense spray, along with a port for spray dispersal.

Yet another form of the invention includes the auxiliary container formed of a material, such as closed cell foam, or an air tight container, providing the ability for the flashlight to float when submerged or dropped into liquid.

A combination flashlight and container device comprising a first casing including a battery operated, manual flashlight with a threaded end, and a second casing detachably connected to the first casing at the threaded end, the second casing having a sealable and totally enclosed compartment.

A container for connection to a flashlight with an end, the container comprising a casing having a sealable, totally enclosed compartment, the casing detachably connectable to the end of the flashlight.

One advantage of the present invention is that an auxiliary container may be attached to a flashlight via the flashlight connection mechanism to its battery cover end cap.

Another advantage of the present invention is that the auxiliary container may have the same outside diameter and circumference as the flashlight body, thereby making an ergonomic and visually appealing device.

Yet another advantage of the present invention is that the auxiliary container may contain a replaceable personal defense spray canister for emergency use.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
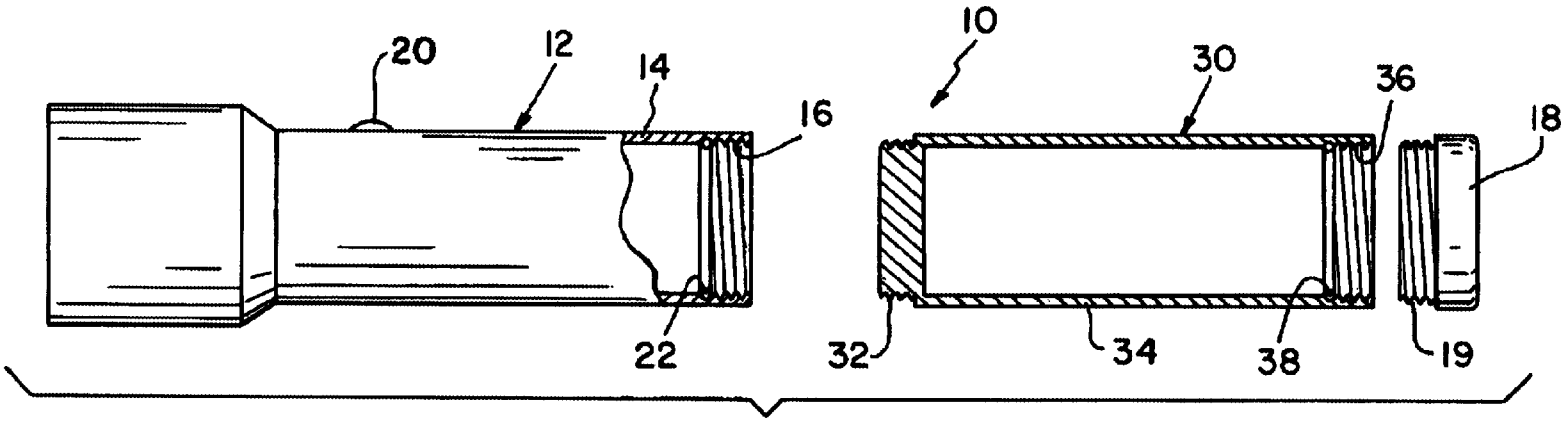
FIG. 1 is an exploded partial sectional view of one form of the present invention.

The assembly of the present invention 10 is shown in FIG. 1. The assembly includes a flashlight 12 including a flashlight casing into which a particular battery powered unit, such as batteries are inserted. Typical flashlight casings are cylindrical in nature, and include either external or internal threaded ends 16 into which an end cap 18 is threadedly attached. One type of flashlight 16 usable in the present invention is that of a Mag-lite® flashlight produced by Mag Instruments, Inc. Alternatively, other flashlights may be utilized in the present invention. Flashlight 12 includes a switch 20 to activate the flashlight lamp (not shown). Further shown in FIG. 1, and in the alternate embodiments of the invention, is an o-ring seal 22 which forms a waterproof seal with either end cap 18 or the container portion of the present invention.

The present invention utilizes an auxiliary container which is attached to flashlight end 16 by means of external threads 32. Alternate attachment mechanisms may be equivalently used to attach the auxiliary container 30 to flashlight casing 14.

In one form of the invention, auxiliary container 30 has a casing 34 formed from aluminum, metal or possibly plastic having an external dimension in either diameter, circumference, or cross-section substantially equal to that of flashlight casing 14. Container 30, having a casing 34, forms a sealable and totally enclosed compartment. Container casing surface 34 may be colored or painted, anodized, or camouflaged to meet the needs of the operator or purchaser. Container casing 34 at the other end includes, in this embodiment, internal threads 36 along with an o-ring 38 into which an end cap 18 may connect. In one form of the invention, end cap 18 is the same end cap which had previously been associated with a complete flashlight 12 for attachment of auxiliary container 30. As shown in FIG. 1, end cap 18 includes external threads 19.

Attachment of this form of auxiliary container 30 is easily conducted. Typically flashlight 12 will include an end cap 18 which may be threadably removed. Container casing 34 may then be rotatably threaded into flashlight casing 14 thereby completing the conventional flashlight battery circuit and acting structurally and functionally as end cap 18. The previously-removed end cap 18 from flashlight 12 is then utilized in sealing the distal end of container casing 34. Interaction of o-ring 38 along with end cap 18 forms a watertight volume into which articles may be stored such as keys, matches, or other items that may be wished to be securely held or concealed the totally sealed and enclosed compartment.

Figure 2:
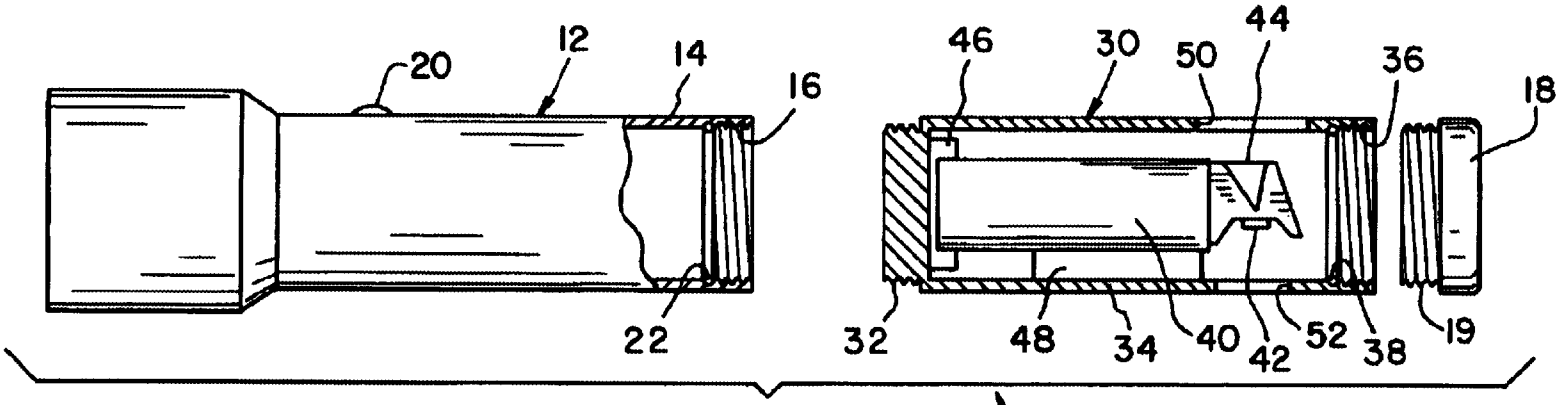
FIG. 2 is an exploded partial sectional view of another form of the present invention.

In another form of the invention as shown in FIG. 2, auxiliary container 30 is shown enclosing a personal defense spray cartridge 40 which includes a spray nozzle 42 and an activator 44 for activating the personal defense spray. A structure for stabily and definitely locating a personal defense spray cartridge 40 within auxiliary container 30 is shown. A base 46 is shown attached to the inside of casing 34 and forming an interference fit with personal defense spray cartridge 40. Alternatively another item or structure such as a formation 48 on the interior of casing 34 may be utilized to stabily locate personal defense spray 40 within auxiliary container 30. The requirements for the base 46 or sidewall formation 48 is that personal defense spray 40 is correctly located, both axially and radially, within auxiliary container 30 so that upon actuation, for example by a finger inserted through port 50 in casing 34, the defense spray nozzle 40 will be located adjacent an exit port 52 to permit effective release of the defense spray.

Figure 4:
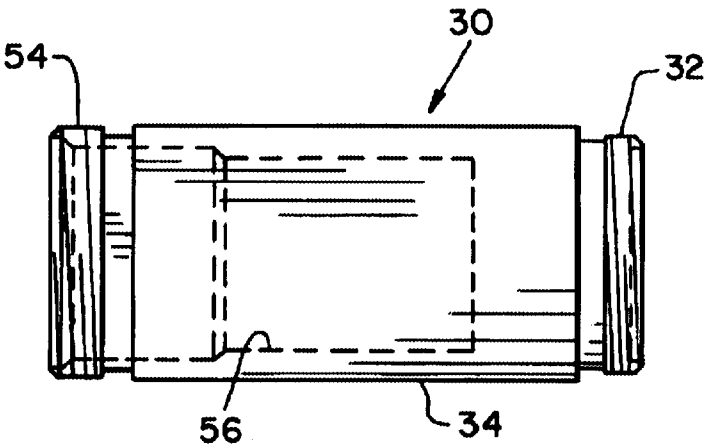
FIG. 4 is a side sectional view of another embodiment of the invention.
Figure 5B:
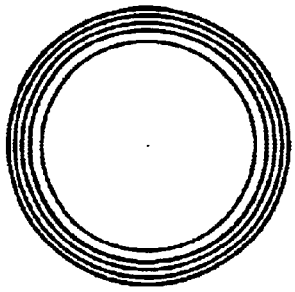
FIG. 5*b* is an axial vial of the container tube shown in FIG. 4.

Other forms of the invention as shown in FIGS. 4–7E show a container casing 34 having a formed or milled-out hollow interior surface 56 that is formed to adapt and slidably lock about the personal defense spray cartridge 40. Shown in FIGS. 4 and 5A, casing 34 includes two external threaded areas, 32 to attach flashlight 12 and a second external threaded area 54. Shown in FIG. 4 is an end cap 55. In this embodiment, an end cap 60 is shown in FIGS. 7A–7E. FIGS. 7A–7D show internal threads 62 into which external threaded area 54 of casing 34 rotatably interfit. End cap 60 includes an internally milled or formed profile 64 that is formed to intent it and interlock with a personal defensive spray canister 40 to prevent the canister's rotation and axial movement within auxiliary container 30. Such interlocking may be formed by an interference fit, snap fit, tongue-and-groove, or dovetail style attachment. The threadable connection between casing 34 and end cap 60 provide for a substantially seamless and continuous outside surface of auxiliary container 30 simulating the appearance of the flashlight casing 14 when fully assembled. As shown in FIGS. 7A–7E, end cap 60 further includes a port 50 for entry of a finger to activate the personal defensive spray canister 40 and an exit port 52 for the contents of the defensive spray. The profile of exit port 52 may be formed to increase the dispersion of the personal defensive spray.

Figure 6A:
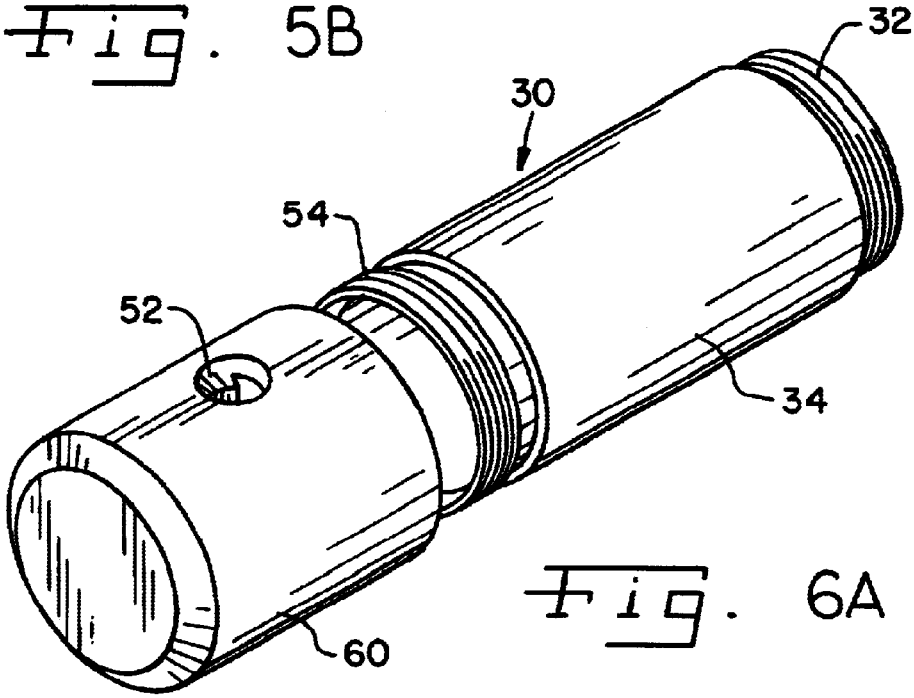
FIG. 6*a* is an exploded perspective view of another form of the invention.
Figure 6B:
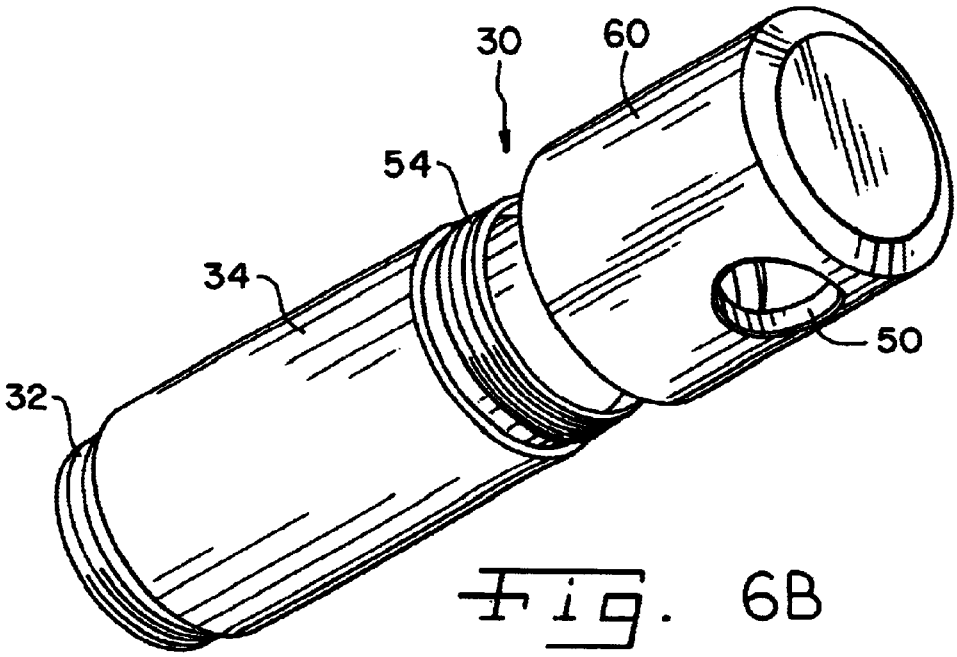
FIG. 6*b* is an exploded perspective view of the embodiment shown in FIG. 6*a*, showing the other side.
Figure 7A:
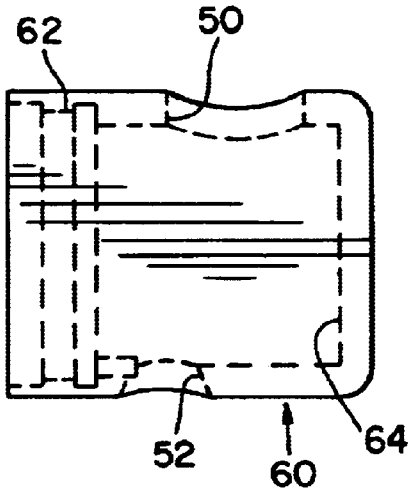
FIG. 7*a* is a side sectional view of the end cap shown in FIG. 6.
Figure 7B:
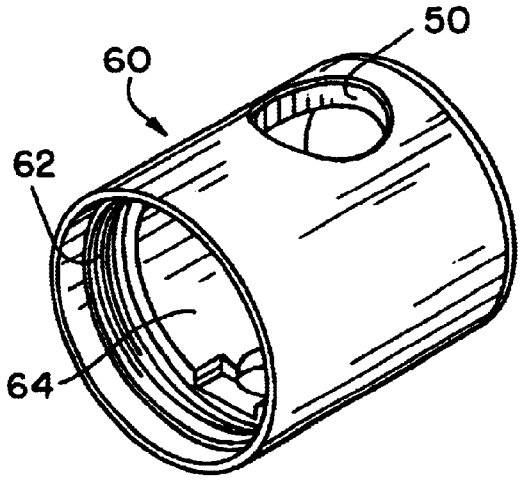
FIG. 7*b* is a perspective view of an end cap.
Figure 7C:
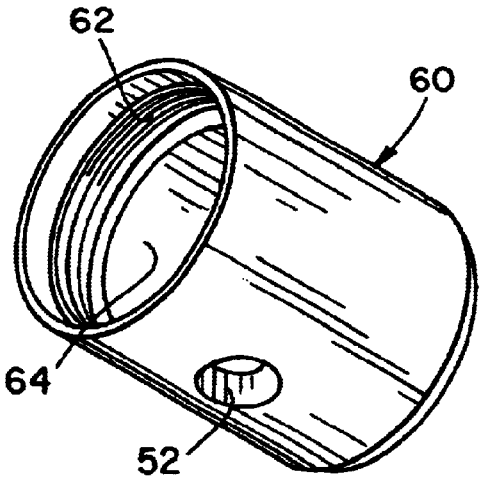
FIG. 7*c* is a perspective view of the other side of the end cap, shown in FIG. 7*b;*
Figure 7D:
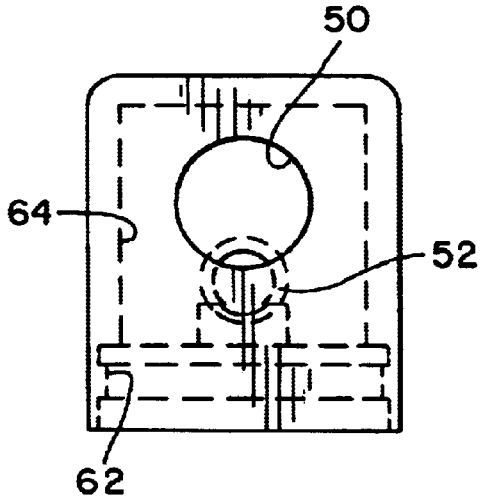
FIG. 7*d* is another sectional view of the end cap shown in FIG. 7*a;*
Figure 7E:
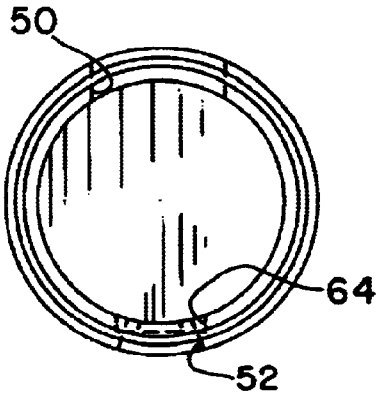
FIG. 7*e* is an axial view of the end cap shown in FIG. 7*a*.

An operation and attachment of this embodiment of the invention to flashlight 12, end cap 18 is removed from flashlight casing 14 and the container casing 34 of FIG. 4 is attached with external threads 32. A personal defensive spray canister 40 may be inserted into end cap 60 interfitting with the internal profile 64 to stabilize and interlock the personal defensive spray 40 within end cap 60 so that the spray nozzle 42 and exit port 52 are aligned. The casing 34 as shown in FIG. 6A is then connected to end cap 60 via external threads 54 interfitting with internal threads 62. A virtually seamless flashlight casing is thereby formed with the personal defensive spray canister 40 concealed therein, and available for use.

Figure 3:
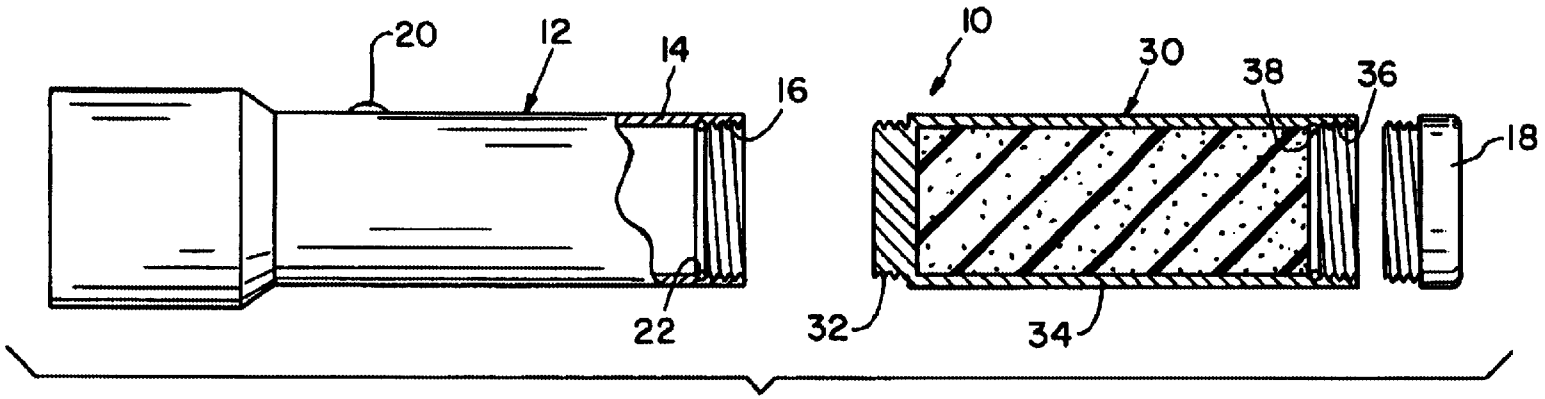
FIG. 3 is an exploded partial sectional view of one form of the present invention.
Figure 5A:
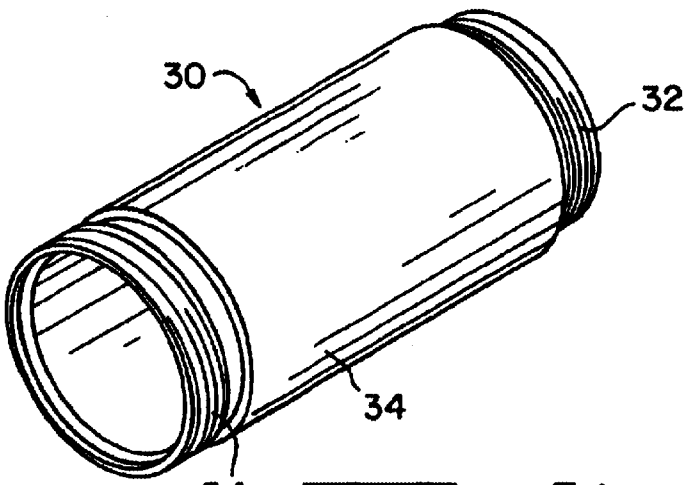
FIG. 5*a* is a perspective view of the container shown in FIG. 4.

Another form of the invention is shown in FIG. 3 in which the auxiliary container 30 includes a floatation means, and in one form is filled with a closed cell foam or other material that floats when immersed in liquids. Alternatively the auxiliary container may simply be hollow or filled with gas for floatation. Such auxiliary container or float may be then attached via threads 32 to flashlight casing 14. Alternatively other floatable materials may be utilized within auxiliary container 30 such as cork, wood, etc.

The invention further includes the utilization of a method of attaching the auxiliary container to the flashlight by attaching it into the same connection to where the flashlight cap typically is located. Such utilization of the auxiliary container and attachment may make a smooth surface and extension to flashlight 12. Alternate other shapes of container casing 34 may also be utilized that do not substantially match flashlight casing 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A combination flashlight and container device comprising:

a first casing including a battery operated, manual flashlight with a threaded end;

a second casing detachably connected to said first casing at said threaded end and thereby forming a first casing connection, said second casing having a sealable and totally enclosable compartment; and an end cap detachably connected to second casing at a location opposite from the first casing connection, at least one of said second casing and a combination of said second casing and said end cap being configured for promoting floatation of said combination flashlight and container device.

2. The combined flashlight and container device of claim 1 in which the outer diameters of said first and second casing are equal.

3. The combined flashlight and container device of claim 1 in which said combination flashlight and container device floats in water when said first casing and second casing are connected and said first casing sinks in water when disconnected from said second casing.

4. The combined flashlight and container device of claim 1 in which said compartment opens to said end cap.

5. The combined flashlight and container device of claim 1 in which said end cap includes a seal.

6. The combined flashlight and container device of claim 1 in which said second casing includes a floatation means for causing said second casing to float in water independent of if said compartment is sealed or not sealed.

7. The combined flashlight and container device of claim 1 in which said second casing includes a threaded end, said first casing threaded end connectable to said second casing threaded end.

8. The combined flashlight and container device of claim 1 in which said second casing includes a threaded end, said second casing threaded end connectable to the flashlight threaded end.

9. A container for connection to a flashlight with an end, said container comprising:

a single casing having a sealable, totally enclosed compartment, sealed by an end cap, said casing detachably connectable to the end of the flashlight, thereby forming a connection to the flashlight, said casing floats when placed in water.

10. The container of claim 9 in which the flashlight has an outer diameter and said casing has an outer diameter, the outer diameters being equal.

11. The container of claim 9 in which said end cap is detachably connected to said casing at a location opposite from the connection to the flashlight.

12. The combined flashlight and container device of claim 11 in which said end cap includes a seal.

13. The container of claim 9 in which said casing includes a floatation means for causing said casing to float in water independent of if said compartment is sealed or not sealed.

* * * * *